US011174858B2

(12) United States Patent
Crocker

(10) Patent No.: US 11,174,858 B2
(45) Date of Patent: Nov. 16, 2021

(54) PUMP FOR MELTED THERMOPLASTIC MATERIALS

(71) Applicant: Waterblasting, LLC, Stuart, FL (US)

(72) Inventor: James P. Crocker, Stuart, FL (US)

(73) Assignee: Waterblasting, LLC, Stuart, FL (US)

( * ) Notice: Subject to any disclaimer, the term of this patent is extended or adjusted under 35 U.S.C. 154(b) by 338 days.

(21) Appl. No.: 16/258,257

(22) Filed: Jan. 25, 2019

(65) Prior Publication Data

US 2019/0234403 A1 Aug. 1, 2019

Related U.S. Application Data

(60) Provisional application No. 62/622,664, filed on Jan. 26, 2018.

(51) Int. Cl.

| | |
|---|---|
| ***F04C 2/00*** | (2006.01) |
| ***F04C 13/00*** | (2006.01) |
| ***F04C 2/12*** | (2006.01) |
| ***B05C 11/10*** | (2006.01) |
| ***E01F 9/524*** | (2016.01) |

(Continued)

(52) U.S. Cl.

CPC ..... *F04C 13/002* (2013.01); *B05C 11/10* (2013.01); *B05C 11/1002* (2013.01); *B05C 11/1044* (2013.01); *E01F 9/524* (2016.02); *E01F 9/588* (2016.02); *F04C 2/126* (2013.01); *B05C 11/1042* (2013.01); *F04C 29/04* (2013.01)

(58) Field of Classification Search

CPC .... F04C 29/04; F04C 29/005; F04C 29/0085; F04C 13/002; F04C 18/126; F04C 2/126; B05C 11/10; B05C 11/1002; B05C 11/1044; B05C 11/1042; E01F 9/524; E01F 9/588; B29C 48/832; B29C 48/37

USPC ..... 417/203, 17, 410.2, 423.1, 321

See application file for complete search history.

(56) References Cited

U.S. PATENT DOCUMENTS 2,515,201 A * 7/1950 Dulmage ..... F04C 2/084 425/379.1

2,940,661 A * 6/1960 Lorenz ..... F04C 18/126 417/354

(Continued)

FOREIGN PATENT DOCUMENTS

| | | |
|---|---|---|
| DE | 202009001316 | 4/2009 |
| GB | 667527 | 3/1952 |
| WO | WO2006092034 | 9/2006 |

*Primary Examiner* — Charles P. Cheyney

(74) *Attorney, Agent, or Firm* — McHale Slavin, P A.

(57) ABSTRACT

An improvement to surface marking devices for pumping and circulating melted thermoplastic material to various surfaces including roads, parking lots and the like is provided. The pump for melted thermoplastic is comprised of a cold section and a hot section. The hot section is connected to a fluid or electric motor, or alternatively, an internal combustion engine for providing rotation to the pump. The connection to provide rotation to the hot section is through the cold section, which is spaced away from the hot section and connected with shafting to provide rotation to the hot section. A heating jacket is secured to the hot section for transferring heat from an external source to the hot section. The spacing between the hot and cold sections provides the ability to rebuild the hot section of the pump without removal from the cold section and without removal from the vehicle to which it is attached.

14 Claims, 25 Drawing Sheets

(51) Int. Cl.
*E01F 9/588* (2016.01)
*F04C 29/04* (2006.01)

(56) References Cited

U.S. PATENT DOCUMENTS 3,746,481 A * 7/1973 Schippers ..... F04C 2/086 418/83
3,837,768 A * 9/1974 Haupt ..... F04C 13/002 418/206.5
4,137,023 A * 1/1979 Moked ..... B29C 48/37 418/15
4,940,394 A * 7/1990 Gibbons ..... F01C 21/102 417/283
4,944,657 A * 7/1990 Mowli ..... F04C 13/002 417/203
5,215,501 A * 6/1993 Ushikoshi ..... F04C 29/0064 415/10
5,348,448 A * 9/1994 Ikemoto ..... F04C 29/0085 417/17
5,393,201 A * 2/1995 Okutani ..... F04C 28/28 417/16
5,494,425 A * 2/1996 Stehr ..... B29C 48/395 418/83
5,549,463 A * 8/1996 Ozawa ..... F04C 18/126 418/3
6,031,610 A * 2/2000 Adams ..... F04C 18/126 356/339
6,371,744 B1 * 4/2002 Mito ..... F04C 29/005 418/179
7,320,579 B2 * 1/2008 Hirano ..... F04C 18/084 418/150
8,784,087 B2 * 7/2014 Hirano ..... F04C 18/126 418/206.5
10,539,133 B2 * 1/2020 Swartzlander ..... F04C 18/126
2008/0107550 A1 * 5/2008 Fujii ..... F04C 18/126 417/423.1
2008/0131302 A1 * 6/2008 Tanigawa ..... F04C 29/005 418/205
2013/0108494 A1 * 5/2013 Varga ..... F04C 14/28 418/1
2018/0065133 A1 * 3/2018 Saine ..... B05C 5/0225
2018/0252213 A1 * 9/2018 Afshari ..... F15B 15/202

* cited by examiner

PUMP FOR MELTED THERMOPLASTIC MATERIALS

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62,622,664, entitled "PUMP FOR MELTED THERMOPLASTIC MATERIALS", filed Jan. 26, 2018. The contents of the above referenced application is incorporated herein by reference in its entirety.

FIELD OF THE INVENTION

This invention relates generally to the field of a road surface marking apparatus; and in particular, to a device for pumping melted or semi-melted thermoplastic material for road marking equipment.

BACKGROUND OF THE INVENTION

In the United States, the first documented use of a painted center line was along Trenton's River Road in Wayne County, Mich., in 1911, when Edward N. Hines watched a leaky milk wagon leave a white trail along a road. A road surface marking is any kind of device or material applied to a road surface in order to convey official information. Typically, road surface markings are used on paved roadways to provide guidance information to both drivers and pedestrians. Marking uniformity is an important factor in minimizing confusion and uncertainty about their meaning, and efforts exist to standardize such markings.

Road surface markings vary in form: surface level permanently affixed, surface level temporarily but not permanently affixed, higher than road surface markers, and/or even mechanical devices. They are designed to inform motorist and pedestrians. Their designs range from merely a daytime or nighttime visual presentation to a raised pavement marker that advises motorist by light reflection or vehicle vibration resulting from contact between the vehicles tires and the raised marker. Efforts to improve road marking systems exist in the realm of the application of such markings, adding retro-reflectivity, increasing longevity, and lowering installation cost.

More specifically, two distinctions exist for road surface markings: mechanical and non-mechanical markings. Mechanical devices may be raised or recessed into the road surface and either reflective or non-reflective. Most mechanical road surface markings are permanent; however, some are movable. Mechanical devices include, but are not limited to Botts' dots, rumble strips, and reflective markers. Botts' dots, low rounded white dots, generally are used to mark the edges of traffic lanes, frequently in conjunction with raised reflective markers. Rumble strips are typically a series of simple troughs that are ground into the asphalt. They can be used across the travel direction to warn of hazards ahead or along the travel direction to warn of hazards of not staying within a specific lane. They create a strong vibration when driven over in order to alert a driver to various upcoming hazards both by sound and the physical vibration of the vehicle. Reflective markers are used as travel lane dividers to mark the median or to mark exit slip-roads. By incorporating a raised retro-reflective element, they are typically more visible at night and in inclement weather than standard road marking lines.

Non-mechanical markings include, but are not limited to paint, thermo-set, tape, and thermoplastic pavement markings. Paint, which sometimes includes additives such as retro-reflective glass beads, is generally used to mark travel lanes, spaces in parking lots or special purpose spaces for disabled parking, loading zones, or time-restricted parking areas. Paint is a low-cost application, and is usually applied right after the road has been paved. The road is marked commonly by a truck called a "striper." These trucks typically contain hundreds of gallons of paint stored in huge drums which sit on the bed. The markings are controlled manually or automatically by a controller who sits on the truck bed. Paint is directed through a series of hoses under pressure and applied to the roadway surface along with the application of glass beads for retro-reflectivity. Painted symbols, such as turn-lane arrows or HOV lane markers, may be applied manually or using stencils. For low traffic areas, traffic paint is suitable and will last for a year or so.

Thermoplastic is one of the most common types of road surface marking based on its balance between cost and performance longevity. It is durable, easy to apply, and reflective. In higher traffic areas, paint simply cannot handle the wear, and will disappear in just a few months. The longevity of thermoplastic makes it a very cost effective traffic control solution. Thus, the use of thermoplastics over paints has increased; mainly due to the performance benefits of increased durability, retro-reflectivity, and a lack of volatile organic compound (VOC) solvents. Furthermore, municipalities like these features because they can budget for a thermoplastic job once every several years instead of having to budget for paint striping every year or so.

Thermoplastic comes in a solid state, is environmentally friendly, and is a user safe compound. It combines a mixture of glass beads, pigments, binders, and filler materials. Its composition offers a variety of positive features: the glass beads provide the retro-reflectivity necessary for its bright night time appearance; pigments provide the color and opacity; the binder mixture provides toughness, flexibility, and bond strength while holding all the components together; and fillers, such as calcium carbonate, sand and/or other inert substances, provide bulk.

Thermoplastic markings are applied using specially equipped trucks. The thermoplastic mix, usually in a brick or pellet form, is heated in the truck to about 400° F. (200° C.) before being supplied to the application apparatus, which is often a screed box, spray dispenser, or ribbon gun, via a pump. Temperature is the most important factor for the proper mixing, melting and bonding of thermoplastic. The thermoplastic mix is heated to a temperature between 400° F. and 440° F. and agitated, causing the thermoplastic compound to become a homogenized liquid. Thus, the pump recirculates a portion of the melted material that is supplied to the pump via gravity to assure that the melted thermoplastic in the lines and pump is maintained at a predetermined temperature. When applied at this temperature, the thermoplastic melts into the upper surface of the asphalt, forming a strong thermal bond. When installed on porous surfaces, such as open-graded asphalt or tined concrete, the hot liquid thermoplastic fills the voids, creating a strong mechanical bond to substrate material.

The apparatus conventionally employed to apply thermoplastic marking material, known as a pavement striping apparatus, includes walk behind systems, systems that are pulled on trailers, or systems that are built on vehicle chassis. The pavement striping apparatus includes one or more large capacity melter hoppers or kettles that maintain a relatively large volume of thermoplastic marking material in a molten state. Such hoppers or kettles are typically oil-jacketed and diesel or propane fired, and can keep as much as 2,000 pounds or more of thermoplastic marking material in a molten state.

Once melted, the thermoplastic marking material must be continuously stirred and cycled through the supply lines to keep the various components of the material from separating and to prevent the thermoplastic material from undergoing thermal degradation or solidification.

Thus, what is lacking in the prior art is a pump for supplying melted thermoplastic material to the application assembly of a pavement striping device for rapidly moving and circulating melted thermoplastic material within a road surface marking machine. The pump should also be capable of being maintained, including being rebuilt without disassembly of the pump from the road marking equipment.

SUMMARY OF THE INVENTION

An improvement to surface marking devices for pumping and circulating melted thermoplastic material to various surfaces including roads, parking lots and the like is provided. The pump for melted thermoplastic is comprised of a cold section and a hot section. The hot section is connected to a fluid or electric motor, or alternatively, an internal combustion engine for providing rotation to the pump. The connection to provide rotation to the hot section is through the cold section, which is spaced away from the hot section and connected with shafting to provide rotation to the hot section. A heating jacket is secured to the hot section for transferring heat from an external source to the hot section. The spacing between the hot and cold sections provides the ability to rebuild the hot section of the pump without removal from the cold section and without removal from the vehicle to which it is attached.

Accordingly, it is an objective of the present invention to provide a pump for melted thermoplastic that provides real-time supply of melted thermoplastic for application to a road surface.

It is another objective of the present invention to provide a pump capable of continuous or intermittent transfer of melted thermoplastic material.

It is yet another objective of the present invention to provide a pump for melted thermoplastic, which may be provided with a heating jacket for melting and reheating melted thermoplastic, allowing the melted resin or plastic materials to flow through the pump and associated conduits.

It is yet another objective of the present invention to provide a pump for melted thermoplastic having a hot section separated from a cold section, the cold section driving the rotation of the hot section.

A further objective of the present invention is to provide a pump for melted thermoplastic that may be driven with hydraulic, pneumatic or internal combustion motors or engines.

It is a further objective of the present invention to provide a pump for melted thermoplastic that can provide agitation to the melted thermoplastic material, wherein the agitation allows for proper mixing of the thermoplastic, as well as ensures even disbursement and uniform temperatures throughout the thermoplastic material mass.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
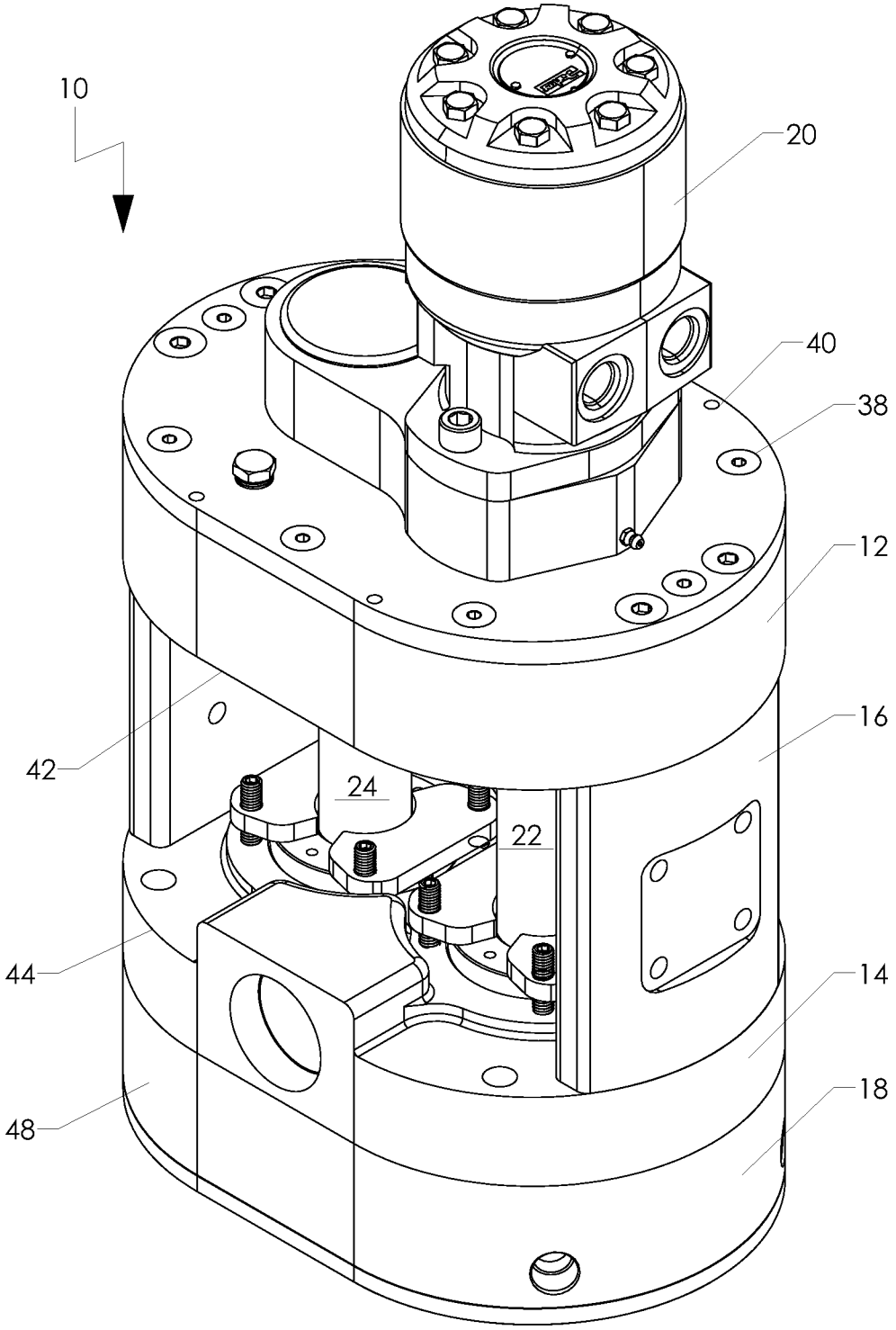
FIG. 1 is a perspective view of the pump for melted thermoplastic.
Figure 2:
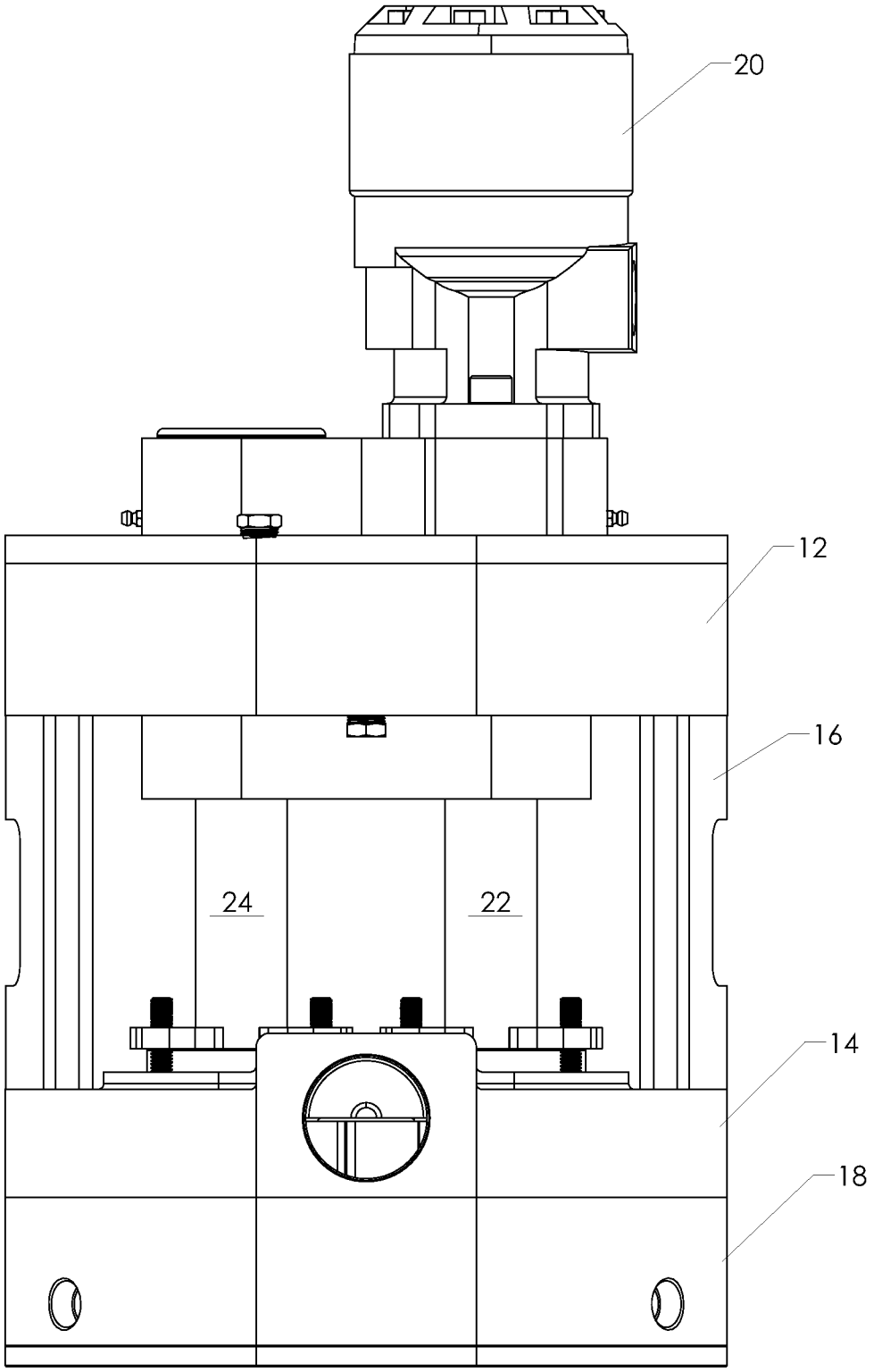
FIG. 2 is a front view of the pump for melted thermoplastic illustrated in FIG. 1.
Figure 3:
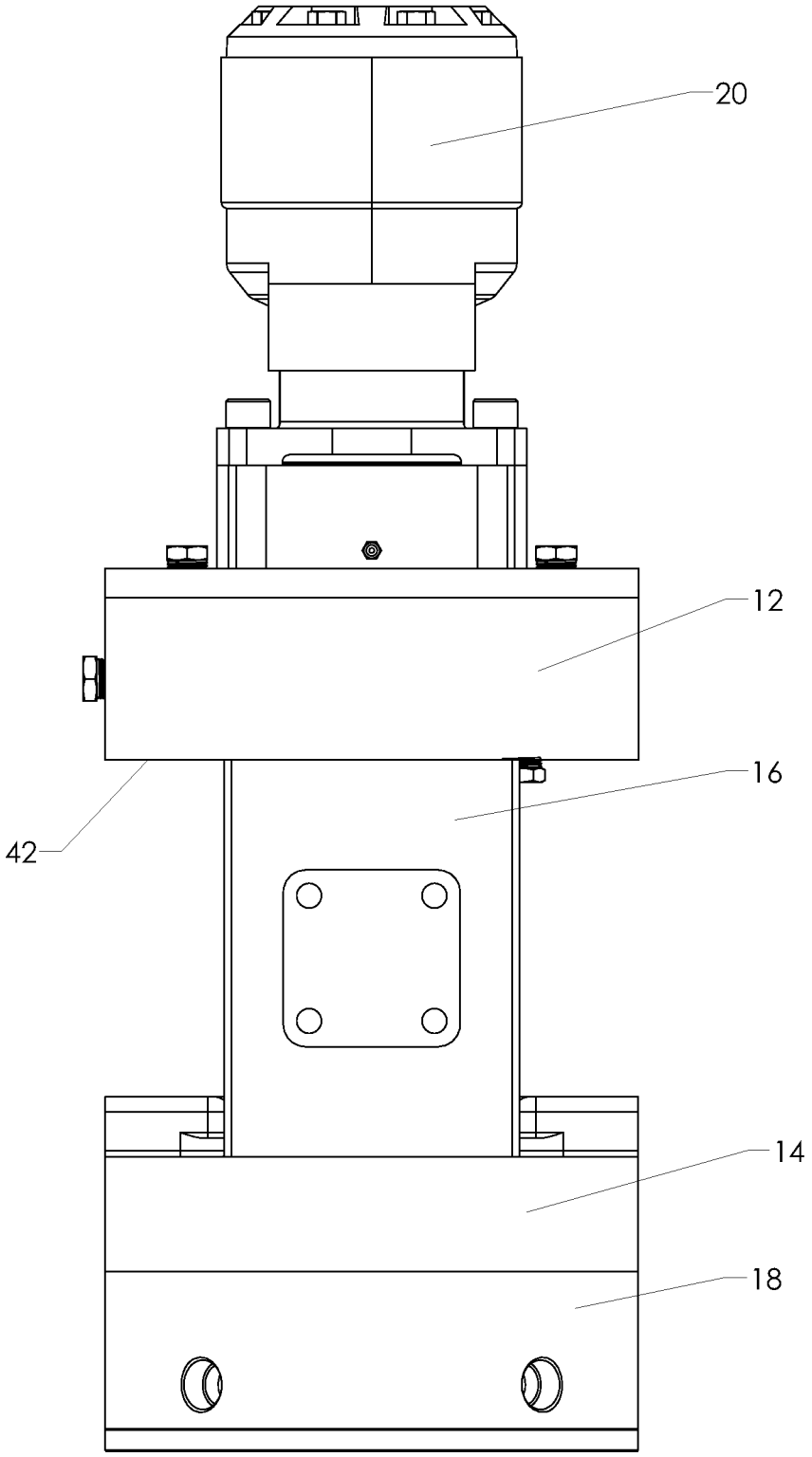
FIG. 3 is a left end view of the pump for melted thermoplastic.
Figure 4:
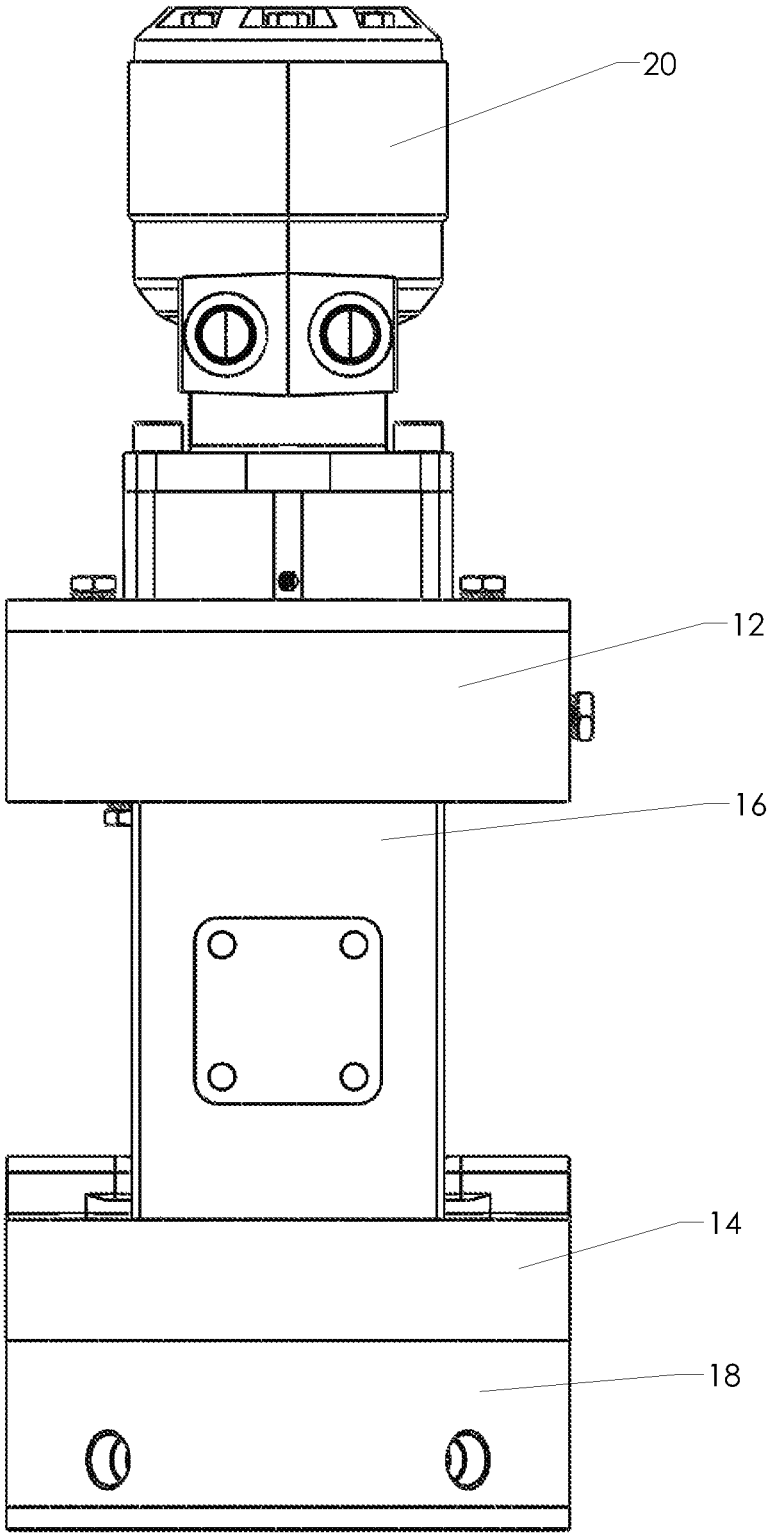
FIG. 4 is a right end view of the pump for melted thermoplastic.
Figure 5:
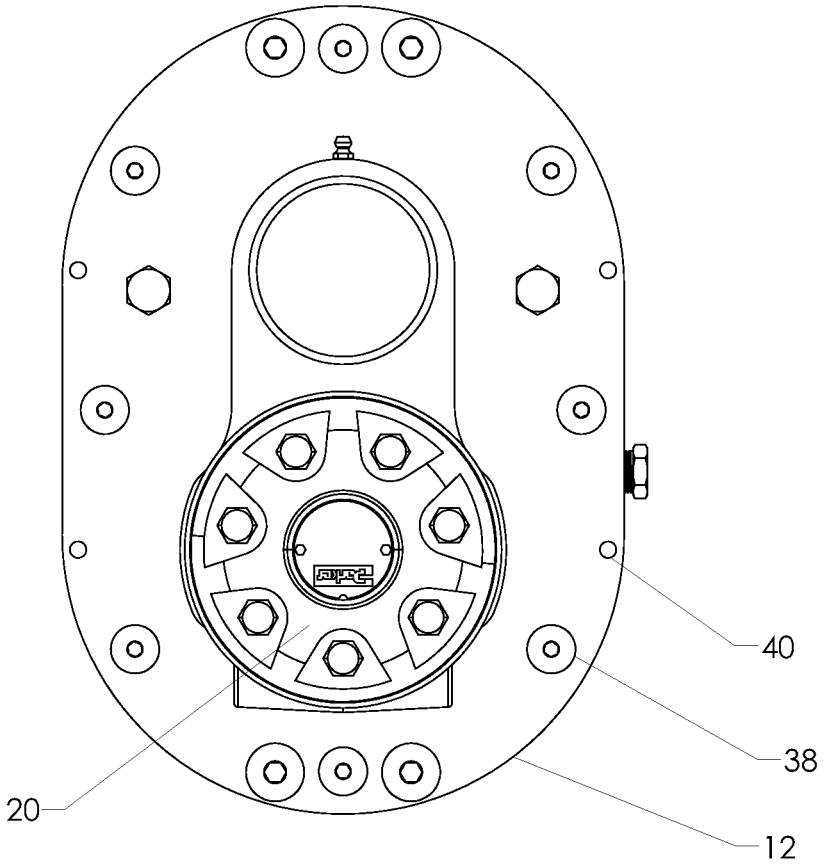
FIG. 5 is a top view of the pump for melted thermoplastic.
Figure 6:
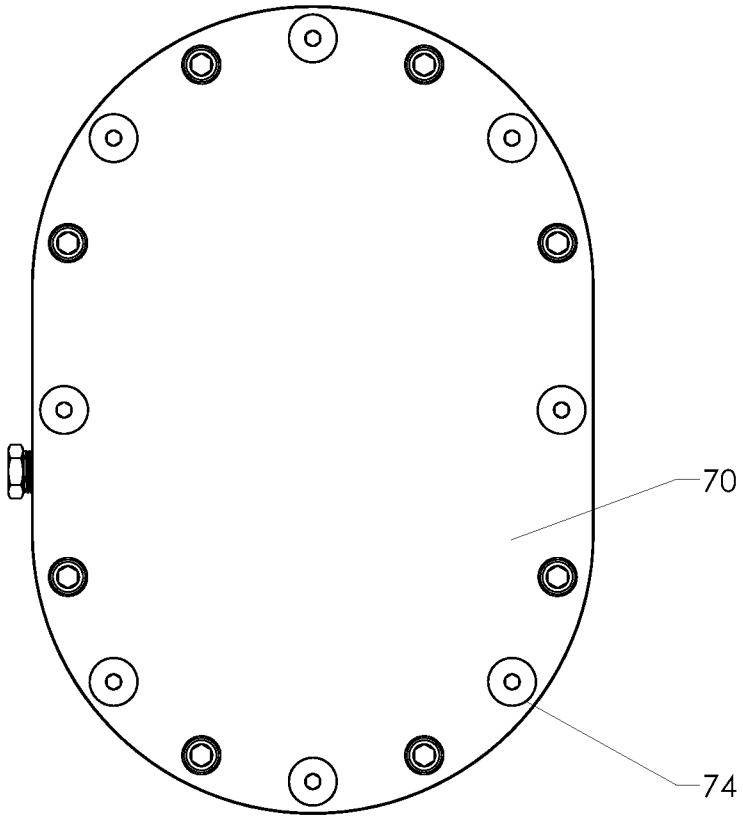
FIG. 6 is a bottom view of the pump for melted thermoplastic.
Figure 7:
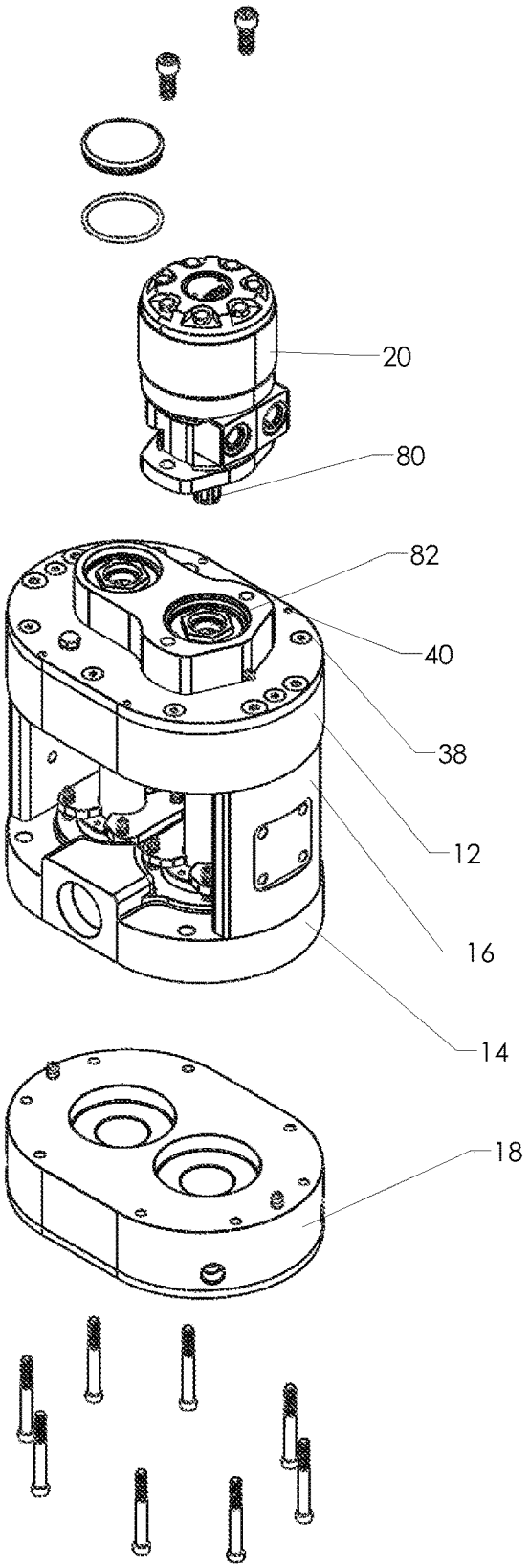
FIG. 7 is a partially exploded view of the pump for melted thermoplastic illustrated with the hydraulic motor and the heating jacket exploded from the pump.
Figure 8:
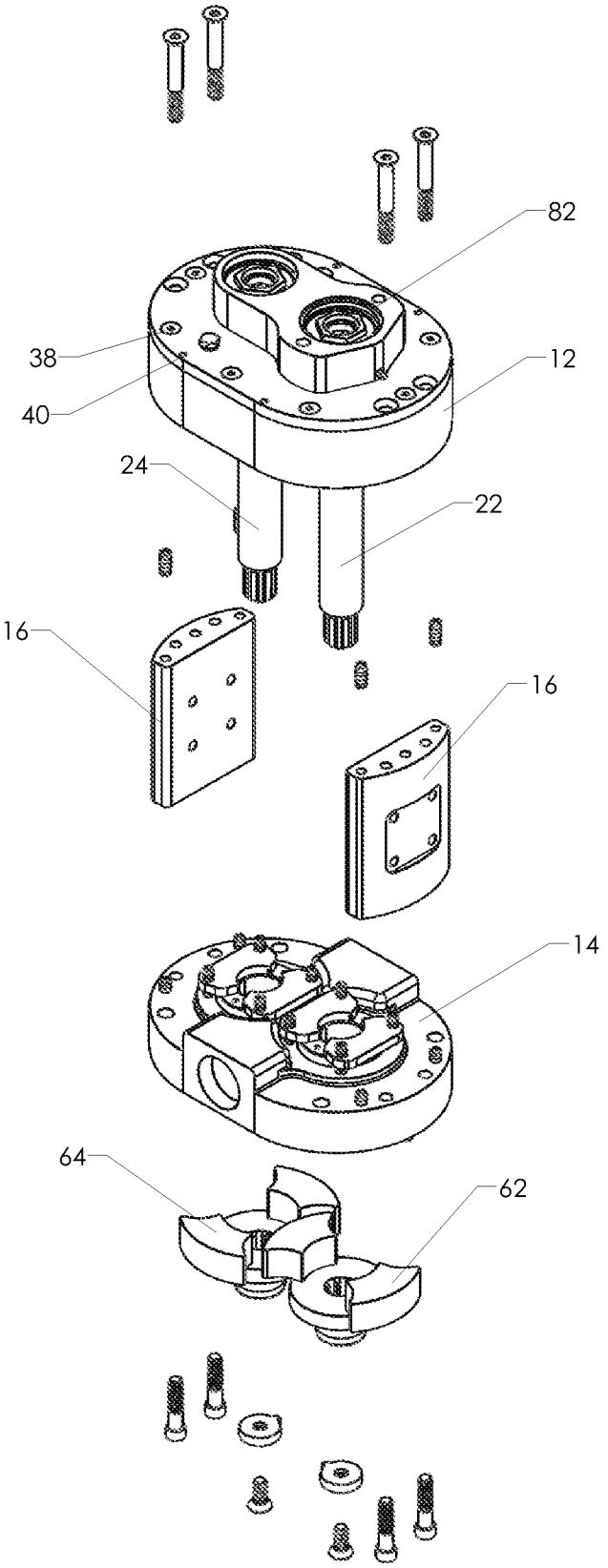
FIG. 8 is a partial exploded view illustrating the cold section separated from the hot section.
Figure 9:
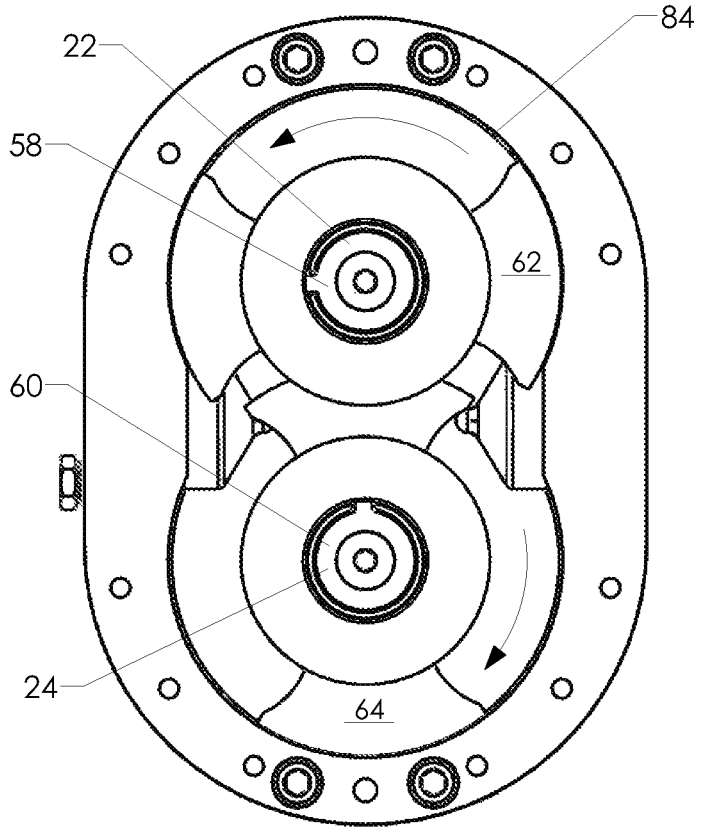
FIG. 9 is a bottom view of the hot section illustrating the transfer lobes.
Figure 10:
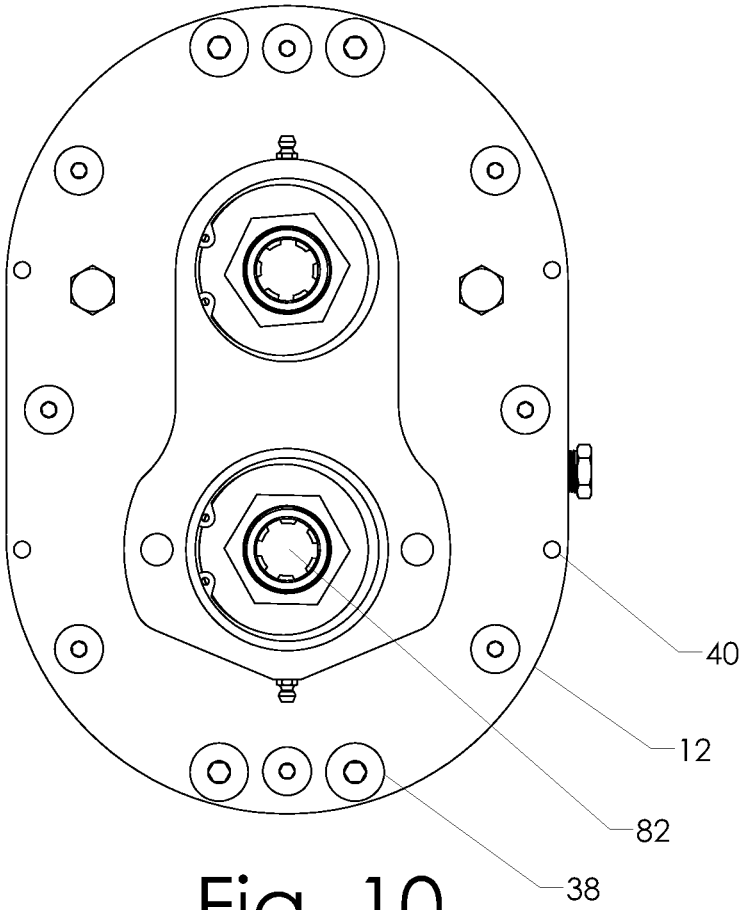
FIG. 10 is a top view of the pump for melted thermoplastic illustrated with the hydraulic motor removed.
Figure 11:
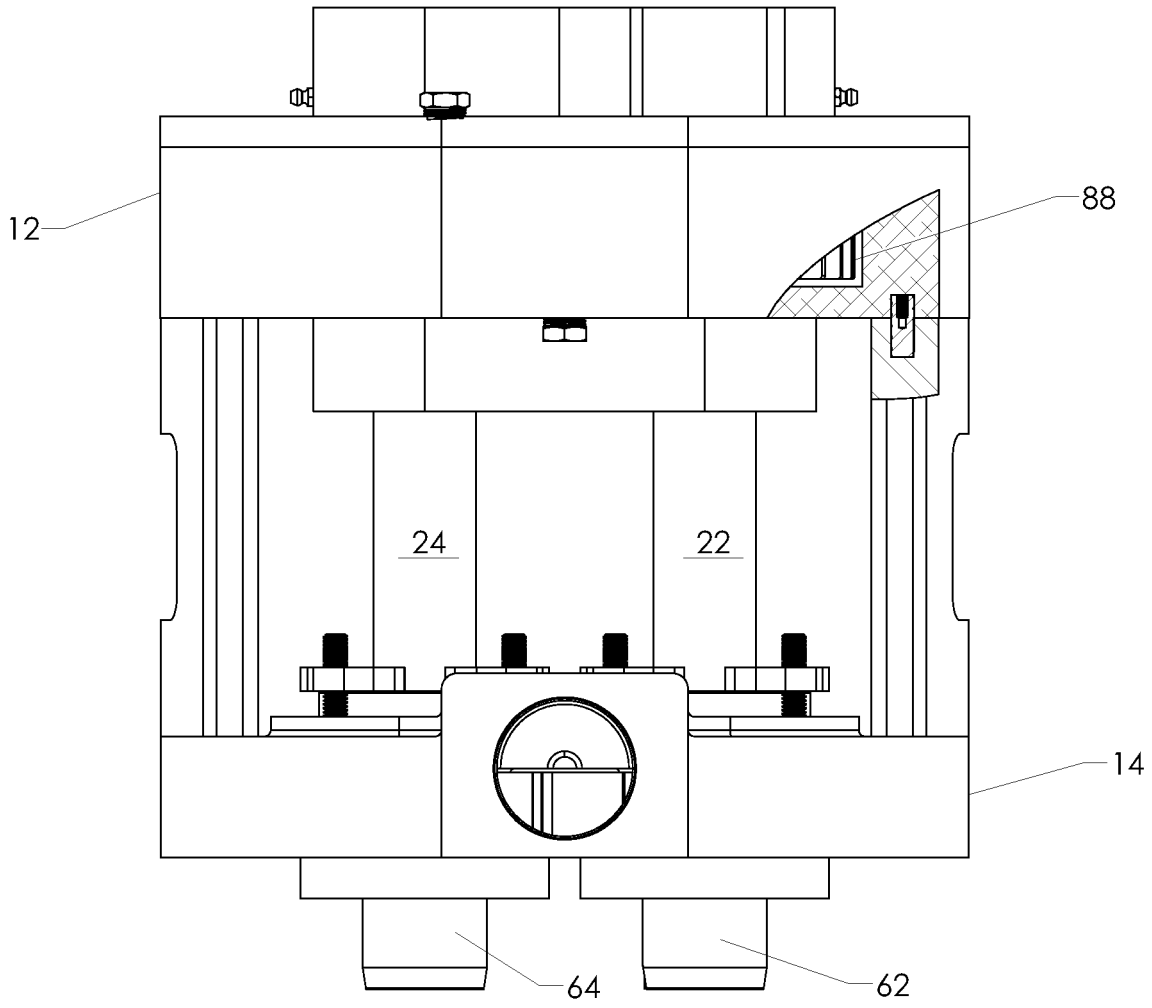
FIG. 11 is a partial side view, partially in section, illustrated with the hydraulic motor and the heating jacket removed showing the attachment of the separating pillars between the hot and the cold sections.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 12:
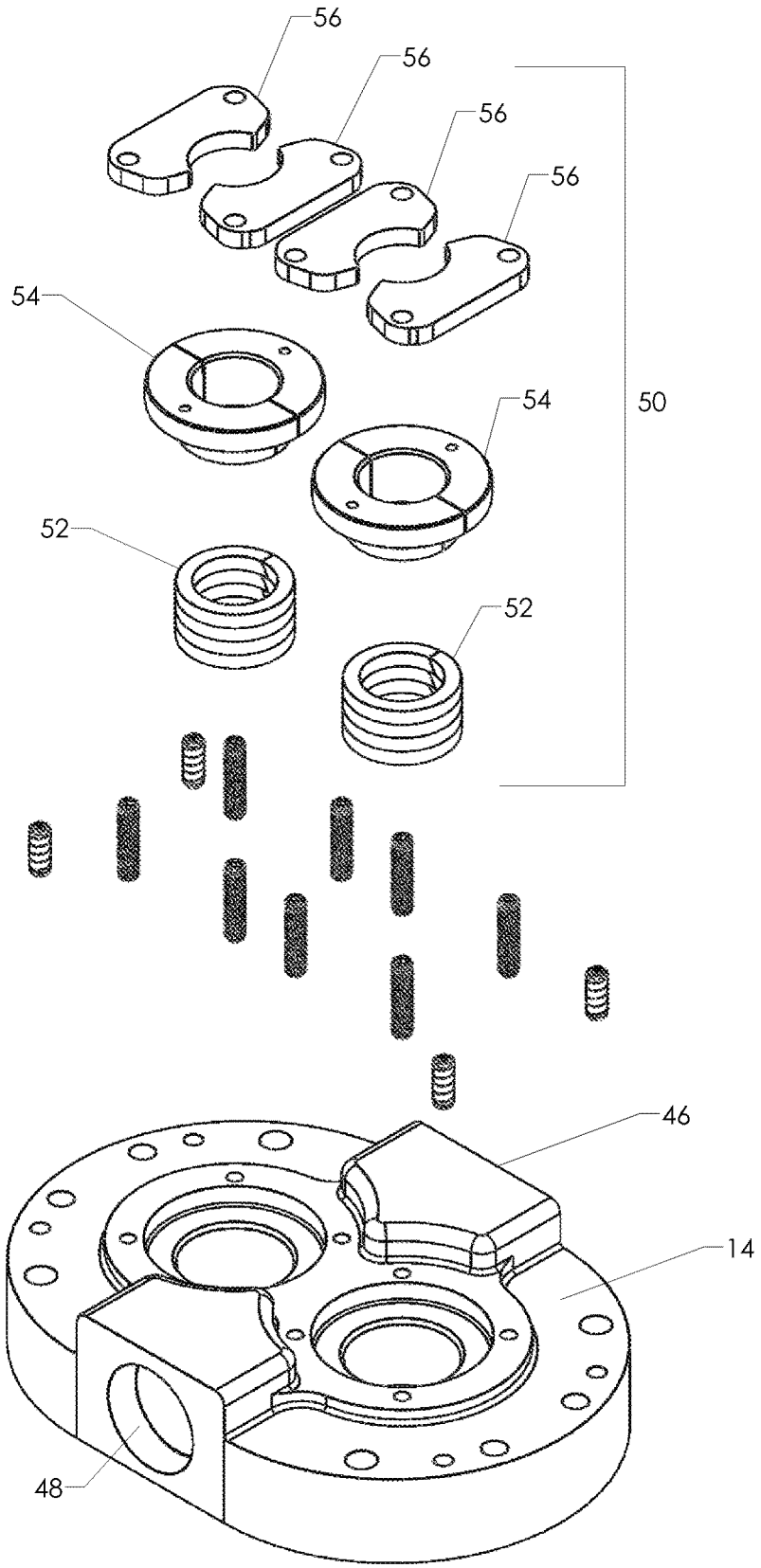
FIG. 12 is an exploded partial view of the hot section illustrating the packing assembly.
Figure 13:
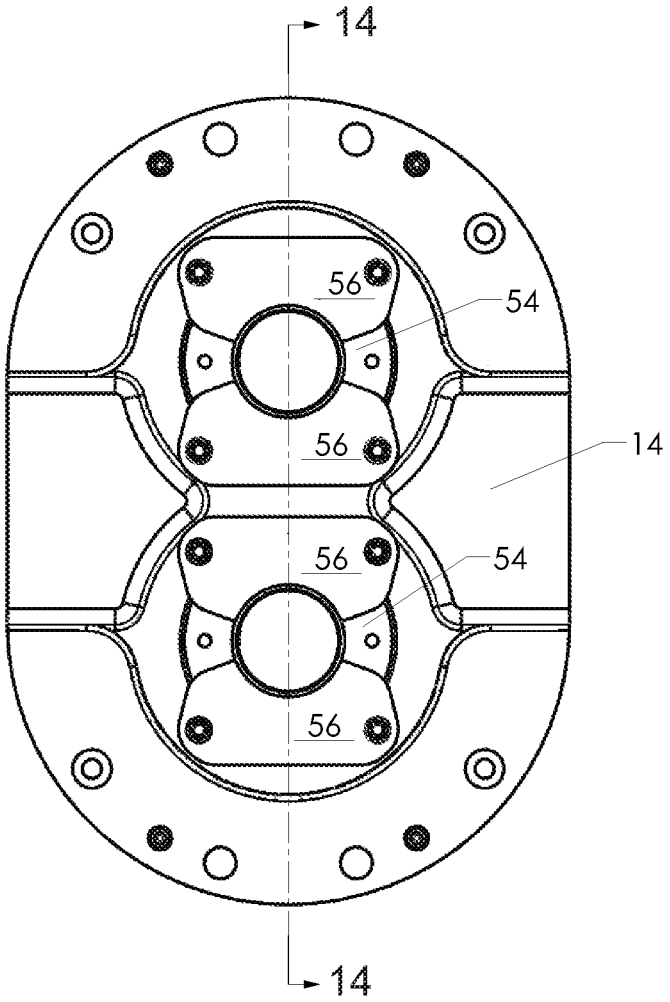
FIG. 13 is a top view of the hot section.
Figure 14:
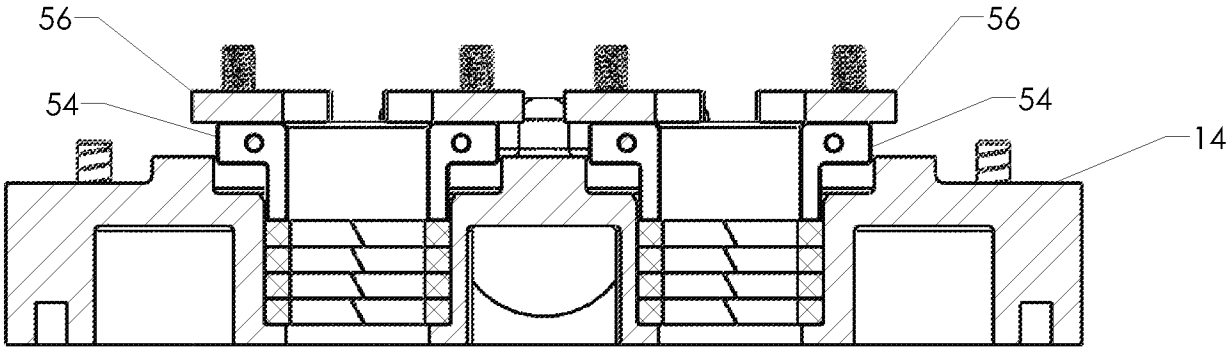
FIG. 14 is a section view taken along lines 14-14 of FIG. 13 illustrating assembly of the packing.
Figure 15:
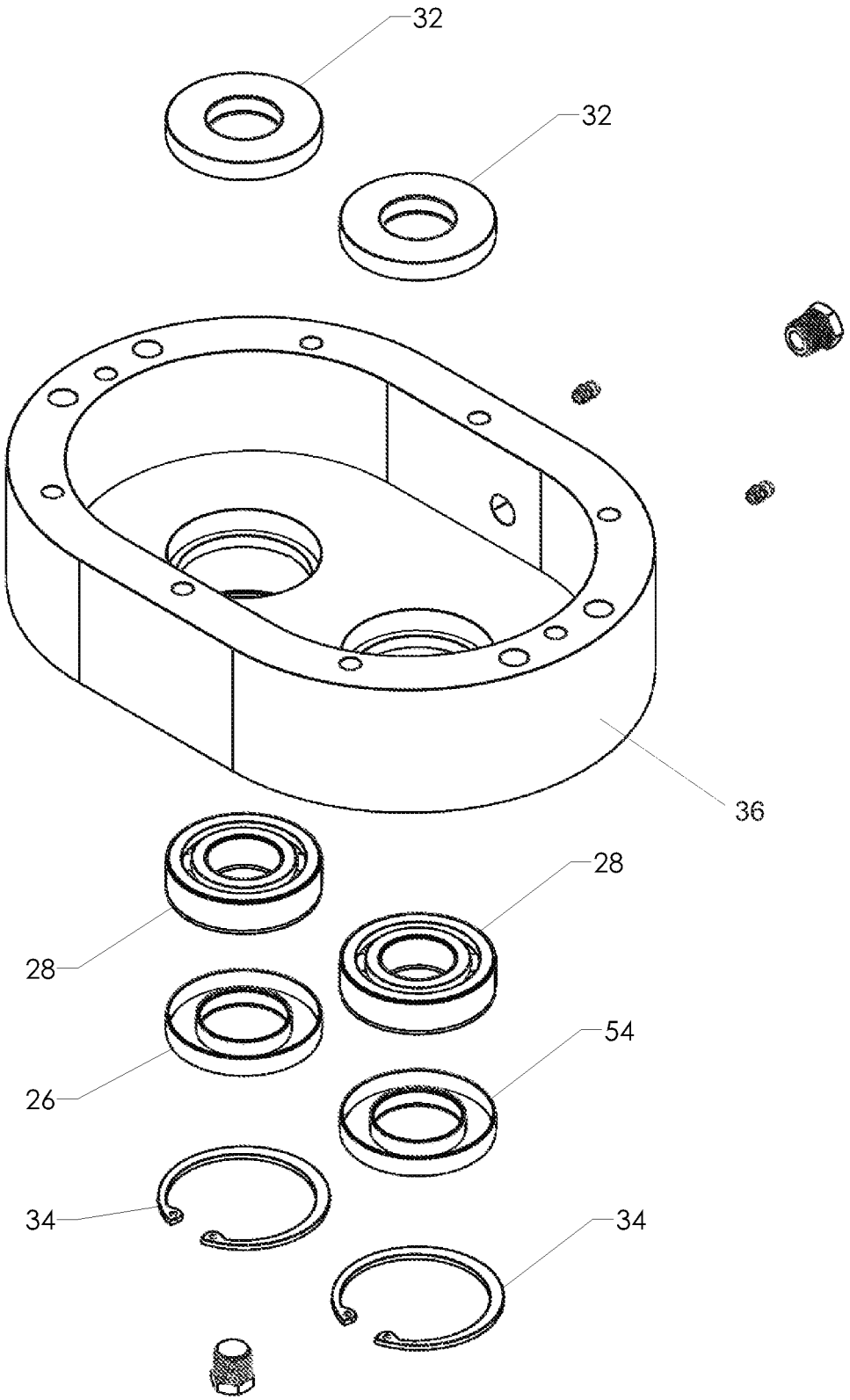
FIG. 15 is a partial exploded view of the lower portion of the cold section.
Figure 16:
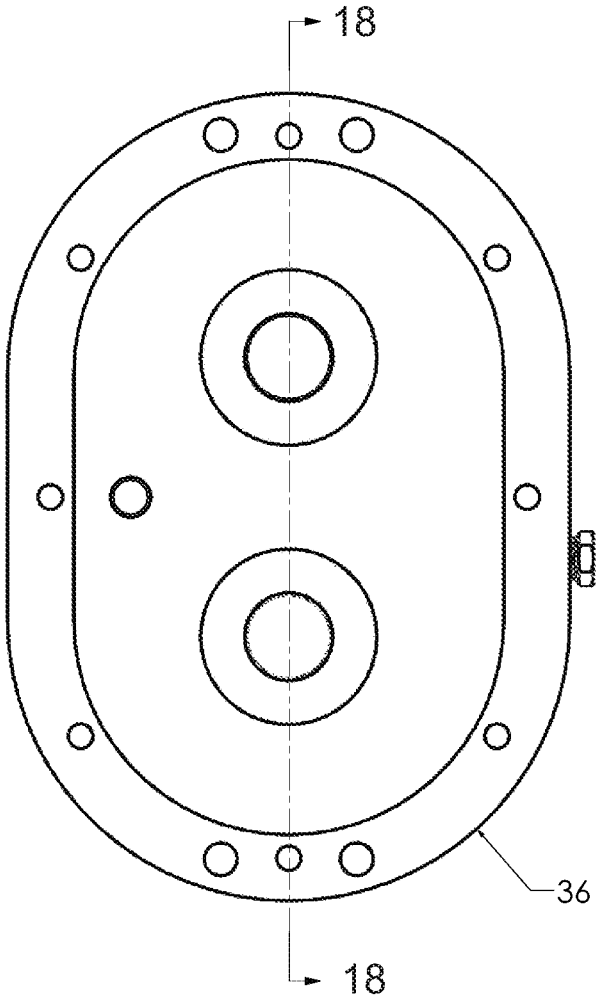
FIG. 16 is a top view of the lower portion of the cold section.
Figure 17:
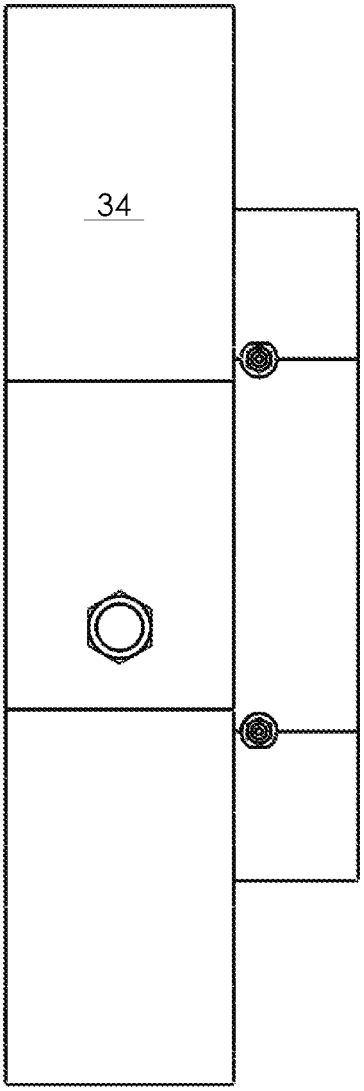
FIG. 17 is a side view of the lower portion of the cold section.
Figure 18:
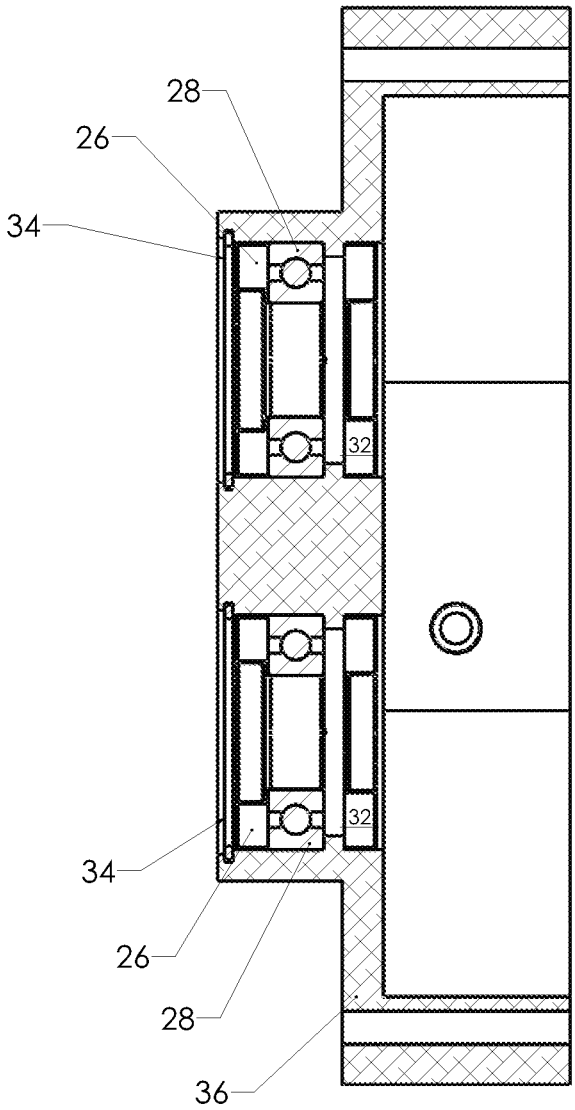
FIG. 18 is a section view of the lower portion of the cold section taken along lines 18-18 of FIG. 16.
Figure 19:
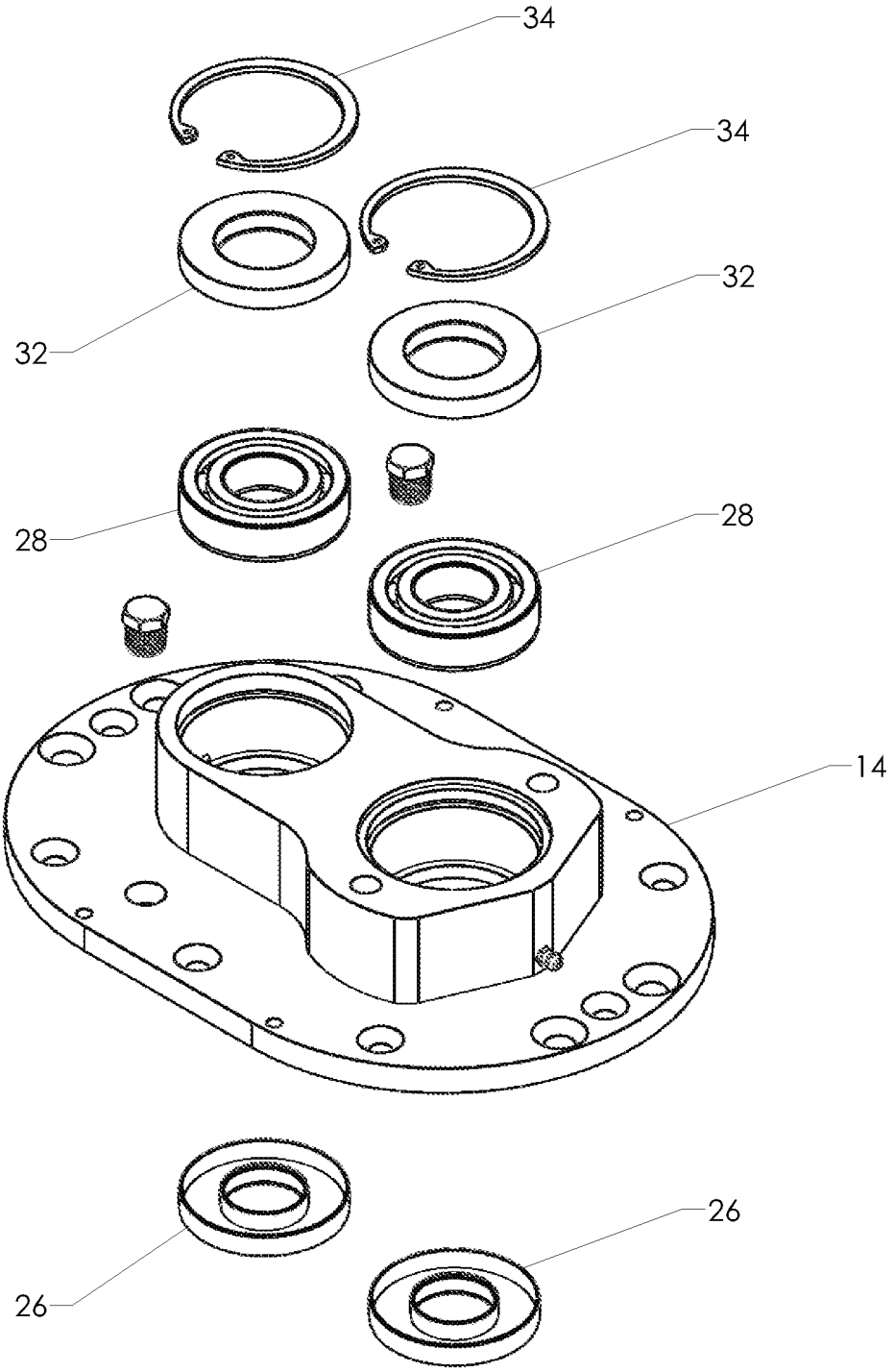
FIG. 19 is an exploded view of the upper portion of the cold section.
Figure 20:
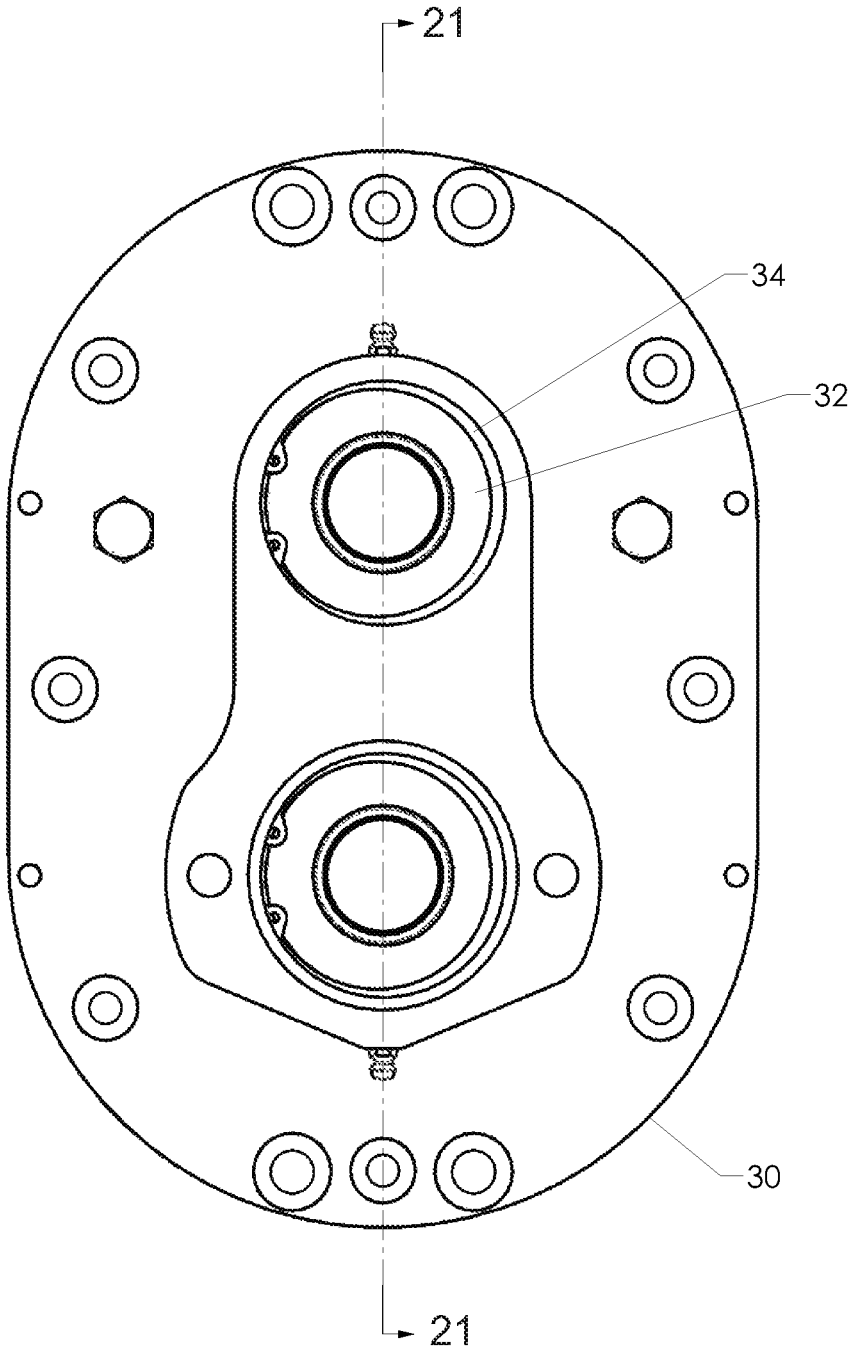
FIG. 20 is a top view of the upper portion of the cold section.
Figure 21:
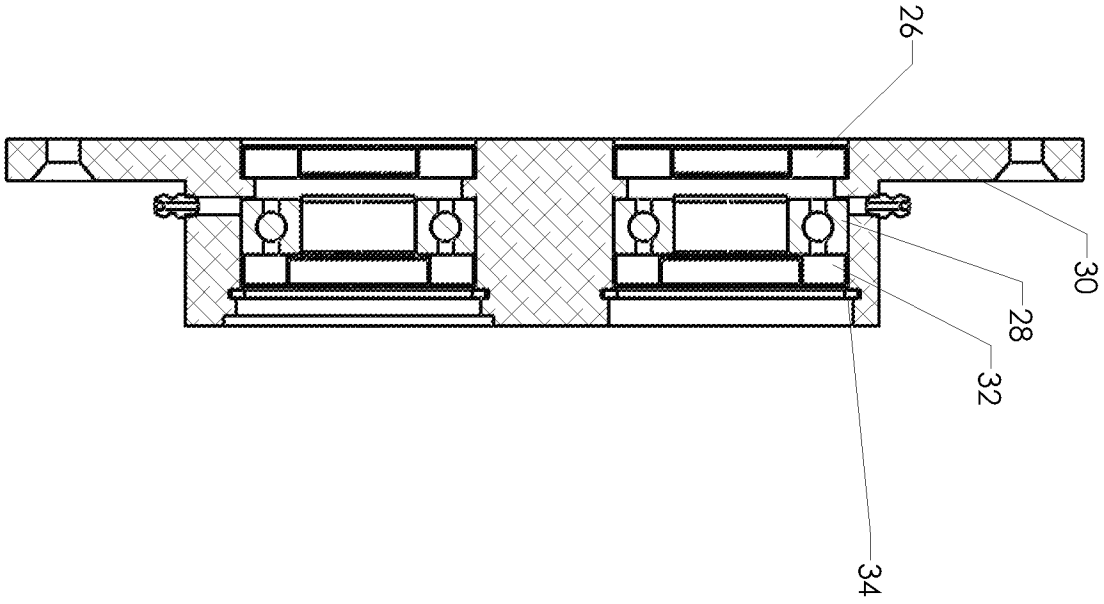
FIG. 21 is a section view of the upper portion of the cold section taken along lines 21-21 of FIG. 20.
Figure 22:
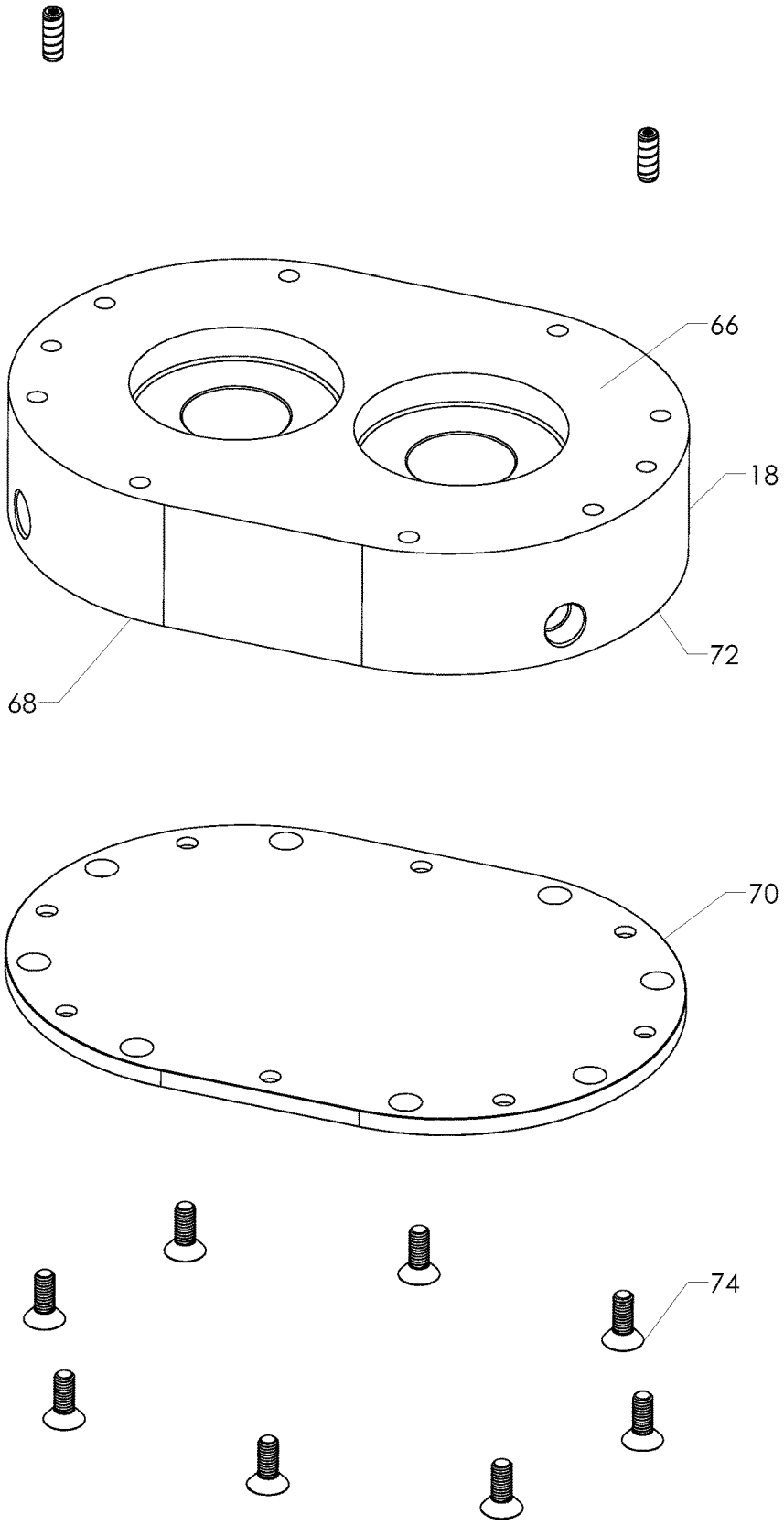
FIG. 22 is an exploded top view of the heating jacket.
Figure 23:
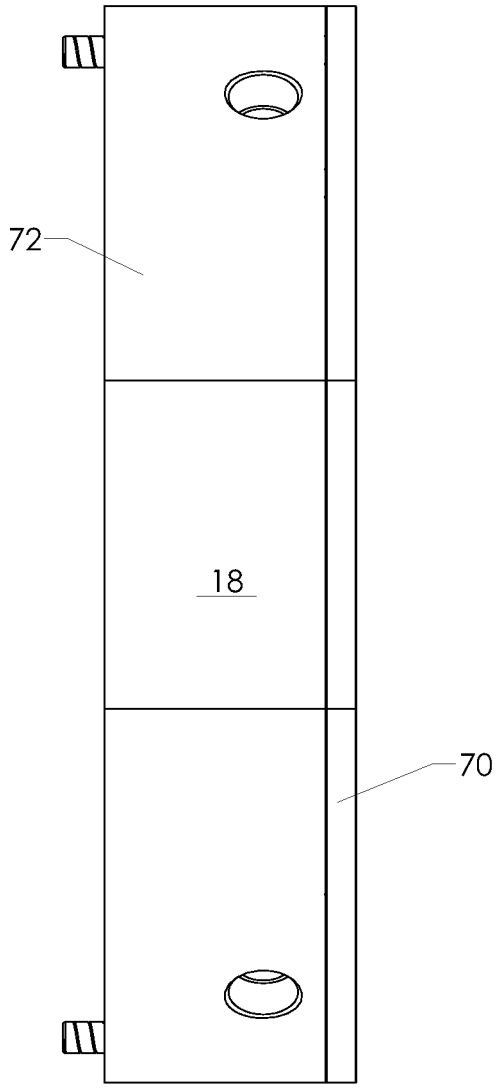
FIG. 23 is a side view of the heating jacket.
Figure 24:
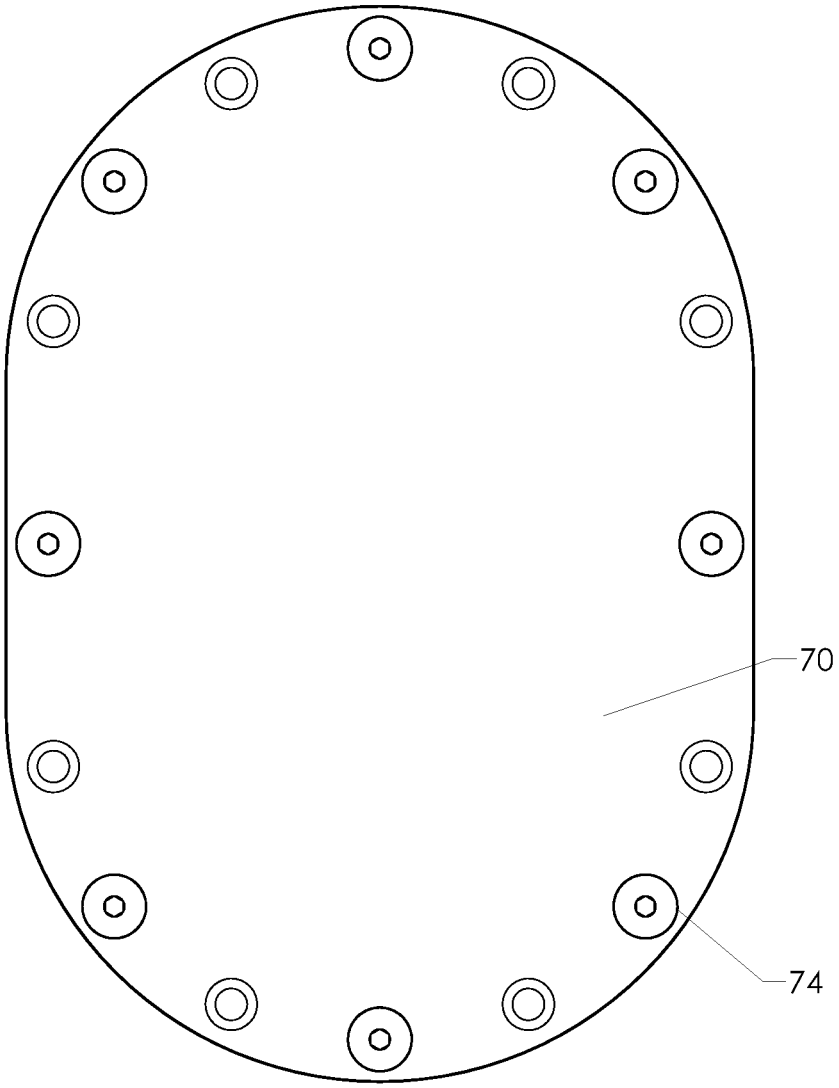
FIG. 24 is a bottom view of the heating jacket.
Figure 25:
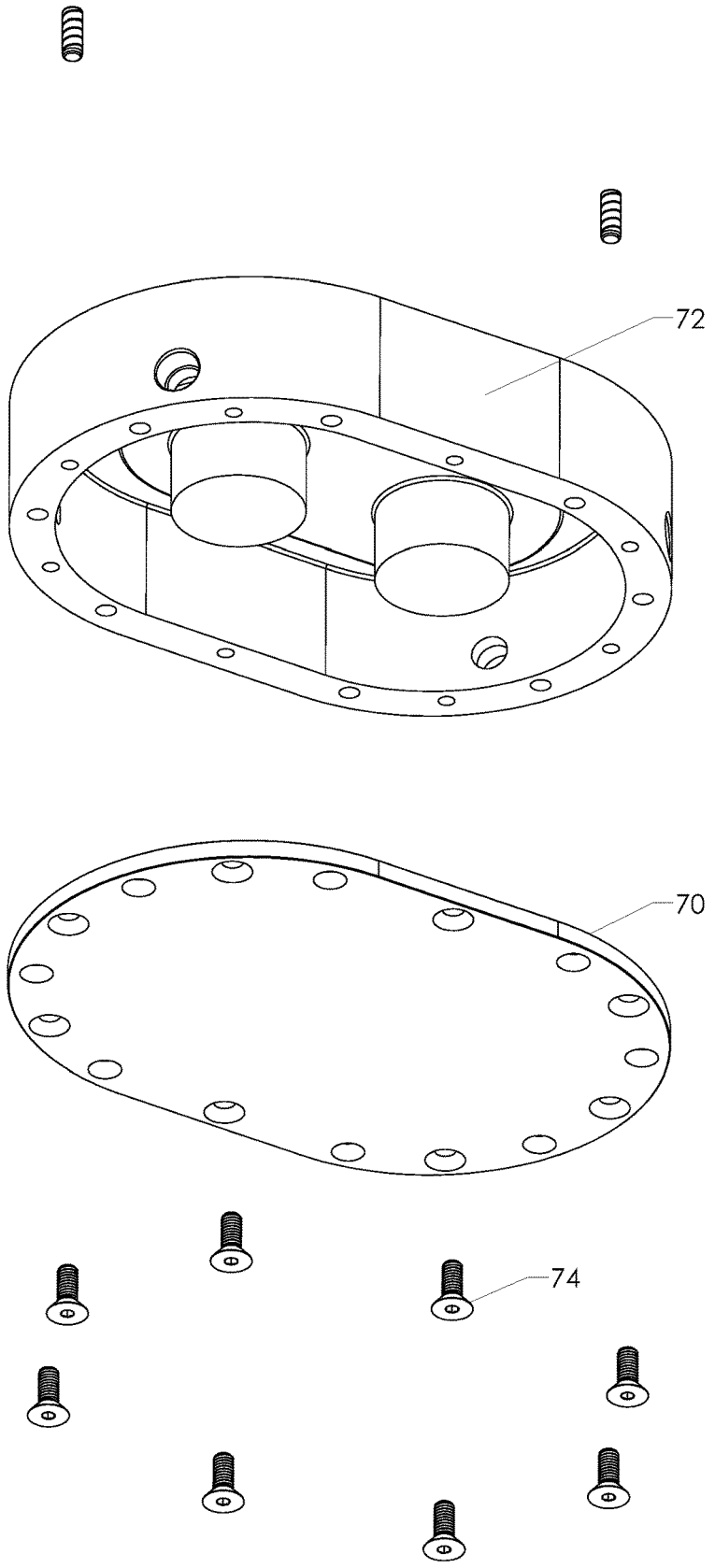
FIG. 25 is an exploded bottom view of the heating jacket.

Now referring to FIGS. 1-25, a pump for melted thermoplastic 10 for transferring and applying thermoplastic material to a road surface is illustrated. The pump for melted thermoplastic includes a cold section 12, a hot section 14, a plurality of separating pillars 16, a heating jacket 18, and a drive motor 20. The drive motor 20 connects to the cold section 12 via splined shafting 80 to input 82. It should also be noted that slip shafting or other suitable connection means for providing rotation motion to the pump from a drive motor may be utilized without departing from the scope of the invention. In the preferred embodiment, the drive motor 20 is a hydraulic motor that includes feedback sensors to provide operator control of the rotational speed of the drive motor, and thus the output of the molten thermoplastic from the pump 10. The drive motor 20 connects to a first through shaft 22 through the cold section input 82, which drives a second through shaft 24 via intermeshed spur gears 88. The spur gears 88 may be replaced with any suitable gear combination that provides counter rotation between the two through shafts 22, 24. Seals 26, bearings 28, thrust washers 32 and snap rings 34 are provided in the top portion 30 of the cold section (FIGS. 19-21) for retention of the through shafts. Seals 26, bearings 28, thrust washers 32 and snap rings 34 are also provided in the bottom portion 36 of the cold section (12) (FIGS. 15-18) for retention of the through shafts. In this manner, the spur gears 88 are allowed to float upon the through shafts 22, 24. The top and bottom portions of the cold section 30, 36 are secured together with fasteners 38 and located with dowel pins 40. The through shafts 22, 24 are provided with an extended length extending out of the bottom portion of the cold section 12 to the hot section 14. Separating pillars 16 extend between a bottom surface 42 of the bottom portion 36 of the cold section 12 and the top surface 44 of the hot section 14. The hot section 14 is constructed from a temperature resistant steel and includes inlet port 46 and outlet port 48 along with packing seal assemblies 50 (FIG. 12). The packing seal assemblies 50 include the packing seals 52, gland nuts 54 and gland nut clamps 56. The packing seal assemblies 50 seal the outer diameters of the through shafts 22, 24. Connected to the second ends 58, 60 of the through shafts 22, 24 are transfer lobes 62, 64 oriented on the through shafts to intermesh with each other for transfer of the molten thermoplastic around the inside perimeter 84 of the hot section 14 between the inlet port 46 and the outlet port 48. In a preferred embodiment, the transfer lobes 62, 64 are keyed or splined to the through shafts so that the transfer lobes rotate at the same speed as the through shafts. It should be noted that the preferred embodiment utilizes a Roots type lobe construction for positive displacement. However, other types of lobe, screw or gear constructions may be utilized with less efficiency, desirability and longevity than the Roots type lobe construction without departing from the scope of the invention. The Roots type lobe is particularly desired for its triangular sealing configuration, both at the point of suction and at the point of discharge. The Roots type lobe is also suitable for operation at low pulsation rates, which are particularly desirable for supply of molten plastic to a road marking device. The top surface 66 of the heating jacket 18 closes the bottom portion of the hot section 14. The heating jacket 18 is formed as a closed hollow chamber through which heated oil is circulated to maintain the temperature of the molten thermoplastic as it is transferred through the pump 10. To close the heating jacket 18, a jacket plate 70 is secured to the bottom surface 68 of the upper portion 72 of the heating jacket 18 with fasteners 74. In this manner, heated oil is allowed to circulate through the heating jacket 18 for heating the hot section 14 for transfer to the thermoplastic material. Baffles, tubes, or the like may be added to the interior of the heating jacket 18 to further enhance the heat transfer from the oil to the hot section 14 without departing from the scope of the invention. The heating jacket 18 components are constructed of a material having a suitable heat transfer coefficient so as to transfer heat from the heated oil to the thermoplastic within the hot section 14.

The pump for melted thermoplastic 10 may be mounted on a walk behind system, pulled on a trailer, or built on a vehicle chassis without departing from the scope of the invention. There are various devices that may be attached to the pump for melted thermoplastic 10 to apply molten thermoplastic onto the pavement surface such as, but not limited to, a ribbon dispenser, spray dispensing device, screed extrusion device, or the like, not shown. The ribbon dispenser is heated and suspended above the road surface, applying a forced-extrusion, well-defined thermoplastic line. The spray dispensing device shall result in a thermoplastic spray pattern that is a uniformly thick, well-defined, and securely bonded stripe. The screed extrusion device has a dispensing shoe that rides directly on the road surface, and a continuous line is formed by a three-sided die with a control gate set to a pre-determined thickness. An actuation means, not shown, is in electric communication with the drive motor 20 on the pump for melted thermoplastic 10. The actuation means actuates the drive motor 20 when the pump for melted thermoplastic 10 is needed to dispense molten thermoplastic. Feedback from the drive motor 20 may be supplied electronically to an electronic controller (not shown) to control the speed of the drive motor to coincide with the use of the melted thermoplastic material. The speed of the drive motor 20 may also be combined with feedback from pressure transducers, flow monitors or the like, to prevent overpressure of the pump. Alternatively, a bypass suitable for bypassing of melted thermoplastic materials back to a tank may be utilized without departing from the scope of the invention.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A pump for melted thermoplastic (10) for transferring and applying thermoplastic material to a road surface comprising:

a cold section (12) including a top portion (30) and a bottom portion (36) secured together, the cold section having an input (82) to through shafts (22, 24), said through shafts (22, 24) intermeshed, in a space between said top portion (30) and said bottom portion (36) of said cold section, to rotate in opposite directions and having an extended length extending out of a bottom portion of said cold section (12) to a hot section (14);

said hot section (14) including a top surface and an inlet port (46) for drawing in melted thermoplastic material and outlet port (48) for providing pressurized melted thermoplastic material therefrom, said hot section including transfer lobes (62, 64) operably connected to the second ends (58, 60) of said through shafts (22, 24) and oriented on said through shafts to intermesh with each other for transfer of said molten thermoplastic around an inside perimeter (84) of said hot section (14) between the inlet port (46) and the outlet port (48);

a heating jacket (18) covering a portion of said hot section (14) for heating said hot section (14);

at least one separating pillar (16) extending between a bottom surface (42) of said bottom portion (36) of said cold section (12) and said top surface (44) of said hot section (14) for providing spacing between said cold section (12) and said hot section (14); and a drive motor (20), said drive motor (20) connecting to said cold section (12) through cold section input (82) for providing rotation to said cold section (12) and said hot section (14).

2. The pump for melted thermoplastic (10) for transferring and applying thermoplastic material to a road surface of claim 1, wherein said lobes are Roots type lobes constructed for positive displacement.

3. The pump for melted thermoplastic (10) for transferring and applying thermoplastic material to a road surface of claim 1, wherein a top surface (66) of said heating jacket (18) closes a bottom portion of said hot section (14).

4. The pump for melted thermoplastic (10) for transferring and applying thermoplastic material to a road surface of claim 3, wherein said heating jacket (18) is formed as a closed hollow chamber through which heated oil is circulated to maintain the temperature of said molten thermoplastic as it is transferred through said pump for melted thermoplastic (10).

5. The pump for melted thermoplastic (10) for transferring and applying thermoplastic material to a road surface of claim 1, including a plurality of said separating pillars (16) extending between said bottom surface (42) of said bottom portion (36) of said cold section (12) and said top surface (44) of said hot section (14).

6. The pump for melted thermoplastic (10) for transferring and applying thermoplastic material to a road surface of claim 5, wherein said separating pillars (16) provide an air gap between said cold section (12) and said hot section (14).

7. The pump for melted thermoplastic (10) for transferring and applying thermoplastic material to a road surface of claim 1, wherein said drive motor 20 is a hydraulic motor that includes feedback sensors to provide operator control of the rotational speed of said drive motor (20), and thus the output of said melted thermoplastic from said pump for melted thermoplastic (10).

8. A pump for melted thermoplastic (10) comprising:

a cold section (12) including a top portion (30) and a bottom portion (36) secured together, the cold section having an input (82) to through shafts (22, 24), said through shafts (22, 24) intermeshed, in a space between said top portion (30) and said bottom portion (36) of said cold section, to rotate in opposite directions and having an extended length extending out of a bottom portion of said cold section (12) to a hot section (14); such that each of said through shafts (22, 24) extends outwardly from said cold section (12) to provide rotation to a rotary portion of said hot section (14), at least one separating pillar (16) extending between a bottom surface (42) of said bottom portion (36) of said cold section (12) and a top surface (44) of said hot section (14), thus spacing said cold section (12) from the hot section (14) providing an air gap there between;

said hot section (14) including intermeshing lobes (62, 64) counter-rotated by said through shafts (22, 24) to provide positive transfer of a melted thermoplastic;

a heating jacket (18) covering a portion of said hot section (14) for heating said hot section (14); and a drive motor (20) for driving said single rotary input of said cold section (12).

9. The pump for melted thermoplastic (10) of claim 8, wherein said lobes (62, 64) are Roots type lobes constructed for positive displacement.

10. The pump for melted thermoplastic (10) for transferring and applying thermoplastic material to a road surface of claim 8, wherein a top surface (66) of said heating jacket (18) closes a bottom portion of said hot section (14).

11. The pump for melted thermoplastic (10) for transferring and applying thermoplastic material to a road surface of claim 10, wherein said heating jacket (18) is formed as a closed hollow chamber through which heated oil is circulated to maintain the temperature of said molten thermoplastic as it is transferred through said pump for melted thermoplastic (10).

12. The pump for melted thermoplastic (10) for transferring and applying thermoplastic material to a road surface of claim 8, including a plurality of said separating pillars (16) extending between said bottom surface (42) of said bottom portion (36) of said cold section (12) and said top surface (44) of said hot section (14), said separating pillars (16) providing said air gap between said cold section (12) and said hot section (14).

13. The pump for melted thermoplastic (10) for transferring and applying thermoplastic material to a road surface of claim 8, wherein said drive motor (20) is a hydraulic motor that includes feedback sensors to provide operator control of the rotational speed of said drive motor, and thus the output of said melted thermoplastic from said pump for melted thermoplastic (10).

14. A method of constructing a pump for melted thermoplastic (10) comprising:

providing a cold section (12) including a top portion (30) and a bottom portion (36) secured together, the cold section having an input (82) to through shafts (22, 24), said through shafts (22, 24) intermeshed, in a space between said top portion (30) and said bottom portion (36) of said cold section, to rotate in opposite directions and having an extended length extending out of the bottom portion of said cold section (12) to a hot section (14);

providing at least one separating pillar (16) extending between a bottom surface (42) of said bottom portion (36) of said cold section (12) and a top surface (44) of said hot section (14) for providing spacing between said cold section (12) and said hot section (14);

connecting a drive motor (20) to said input (82) of said cold section (12) for driving said pump for melted thermoplastic (10) such that said through shafts (22, 24) extends rotational motion from said cold section (12) to said hot section (14) from said drive motor (20) for transfer of melted thermoplastic, said hot section (14) including two intermeshing Roots type lobes (62,

64) connected to a distal end of said through shafts (22, 24) for positive transfer of said melted thermoplastic;

connecting a heating jacket (18) to said hot section (14) for heating said hot section (14) of said pump for melted thermoplastic (10).

* * * * *